US008875687B1

(12) United States Patent
Huang et al.

(10) Patent No.: US 8,875,687 B1
(45) Date of Patent: Nov. 4, 2014

(54) TANGENT POINT ARROW REST

(71) Applicants: Dorge O. Huang, Henry, IL (US); James J. Kempf, Coralville, IA (US)

(72) Inventors: Dorge O. Huang, Henry, IL (US); James J. Kempf, Coralville, IA (US)

( * ) Notice: Subject to any disclaimer, the term of this patent is extended or adjusted under 35 U.S.C. 154(b) by 143 days.

(21) Appl. No.: 13/687,534

(22) Filed: Nov. 28, 2012

Related U.S. Application Data

(60) Provisional application No. 61/630,298, filed on Dec. 8, 2011.

(51) Int. Cl.
*F41B 5/22* (2006.01)
*F41B 5/14* (2006.01)

(52) U.S. Cl.
CPC ..... *F41B 5/143* (2013.01)
USPC ..... 124/44.5; 124/24.1

(58) Field of Classification Search
CPC ..... F41B 5/143
USPC ..... 124/44.5, 24.1
See application file for complete search history.

(56) References Cited

U.S. PATENT DOCUMENTS

| | | | | | |
|---|---|---|---|---|---|
| 2,998,811 | A | * | 9/1961 | Sackmann | 124/24.1 |
| 3,504,659 | A | * | 4/1970 | Babington | 124/24.1 |
| 4,324,221 | A | * | 4/1982 | Peck | 124/24.1 |
| 4,598,688 | A | * | 7/1986 | Paul et al. | 124/44.5 |
| 5,025,773 | A | * | 6/1991 | Hintze et al. | 124/44.5 |
| 5,031,601 | A | * | 7/1991 | Gunter | 124/44.5 |
| 5,042,450 | A | * | 8/1991 | Jacobson | 124/44.5 |
| 5,085,201 | A | * | 2/1992 | Tepper et al. | 124/44.5 |
| 5,144,937 | A | * | 9/1992 | Colvin | 124/44.5 |
| 5,245,980 | A | * | 9/1993 | Colvin | 124/24.1 |
| 5,251,606 | A | * | 10/1993 | Colvin | 124/44.5 |
| 5,253,633 | A | * | 10/1993 | Sisko | 124/44.5 |
| 5,261,383 | A | * | 11/1993 | Halamay | 124/44.5 |
| 5,327,877 | A | * | 7/1994 | Shaw, III | 124/24.1 |
| 5,419,303 | A | * | 5/1995 | Stewart | 124/44.5 |
| 5,460,151 | A | * | 10/1995 | Hamilton et al. | 124/44.5 |
| 5,460,152 | A | * | 10/1995 | Specht | 124/44.5 |
| 5,462,041 | A | * | 10/1995 | Solecki | 124/44.5 |
| 5,529,049 | A | * | 6/1996 | Antalosky | 124/44.5 |
| 5,685,287 | A | * | 11/1997 | Greywall | 124/44.5 |
| 5,992,402 | A | * | 11/1999 | Vyprachticky | 124/44.5 |
| 6,039,036 | A | * | 3/2000 | Padilla | 124/44.5 |
| 6,557,541 | B2 | * | 5/2003 | Pinto, Jr. | 124/44.5 |
| 6,561,175 | B1 | * | 5/2003 | Tidmore | 124/44.5 |
| 6,634,349 | B2 | * | 10/2003 | Mizek et al. | 124/44.5 |
| 6,688,296 | B1 | * | 2/2004 | Greywall | 124/44.5 |
| 6,742,511 | B1 | * | 6/2004 | Remme | 124/44.5 |
| 6,772,747 | B1 | * | 8/2004 | Vastag | 124/44.5 |
| 6,789,535 | B1 | * | 9/2004 | McIntyre | 124/44.5 |
| 6,994,080 | B1 | * | 2/2006 | Yoder | 124/44.5 |
| 7,913,678 | B2 | * | 3/2011 | Hudkins | 124/44.5 |
| 8,342,161 | B2 | * | 1/2013 | Harwath et al. | 124/44.5 |

* cited by examiner

*Primary Examiner* — Gene Kim
*Assistant Examiner* — Alexander Niconovich
(74) *Attorney, Agent, or Firm* — Donald J. Ersler

(57) ABSTRACT

A tangent point arrow rest preferably includes an outer housing, at least two bearing assemblies and a mounting device. The outer housing includes an arrow clearance opening for insertion of an arrow shaft. Threaded bearing holes are formed through the outer housing. The mounting device may be a mounting rod or at least one boss slot, which extend from the outer housing. Each bearing assembly preferably includes a bearing housing, a tension adjustment screw, a bearing housing cap, a contact ball bearing, an inner ball bearing and a compression spring. The inner ball bearing, the tension spring and tension adjustment screw are retained in the bearing housing. The bearing housing is threaded into one of the threaded bearing holes. The bearing housing cap is threaded on to the bearing housing to retain the contact ball bearing.

17 Claims, 6 Drawing Sheets

TANGENT POINT ARROW REST

CROSS-REFERENCES TO RELATED APPLICATIONS

This is a utility patent application taking priority from provisional application No. 61/630,298, filed on Dec. 8, 2011.

BACKGROUND OF THE INVENTION

1. Field of the Invention

The present invention relates generally to archery and more specifically to a tangent point arrow rest, which fully captures an arrow for both bows and crossbows.

2. Discussion of the Prior Art

Historically, archery bows have been used for war, survival, sport, and recreation. A specific component of a bow is the device that supports the arrow while the bow is at rest, during the draw cycle, the first portion of flight and the launch. Originally, the archer's hand that held the bow was used. The archer simply rested the arrow on the top of his thumb and index finger. A first improvement for the arrow rest was an actual ledge on the center portion of the bow, which gave a consistent placement of the arrow for each shot. Further improvements included dual prong rests, flipper style rests and fall away arrow rests. One of the more recent type of arrow rest is known as the Whisker Biscuit, a type of arrow rest that surrounds the arrow with a plurality of bristles, which support the arrow.

There are many draw backs to current arrow rests. Prong and flipper style arrow rests function well, so long as the arrow does not fall off prematurely. The drop away style of arrow rest also has the draw back of the arrow prematurely falling off, as well as the relative difficulty of timing the drop cycle of the rest. The full capture style rest, such as the Whisker Biscuit, does not have these issues. However one significant draw back of the Whisker Biscuit is that the vanes of the arrow drag on the plurality of bristles, and which causes the arrow to have a great deal of drag as it travels through the plurality of bristles.

Accordingly, there is a clearly felt need in the art for a tangent point arrow rest, which fully captures an arrow for both bows and crossbows and supports the arrow shaft with ball bearings to provide point contact and reduce friction.

SUMMARY OF THE INVENTION

The present invention provides a tangent point arrow rest, which supports the arrow shaft with ball bearings. The tangent point arrow rest preferably includes an outer housing, at least two bearing assemblies and a mounting device. The mounting device could be a mounting rod attached to the outer housing or at least one flange extending from the outer housing. The outer housing includes an arrow clearance opening for insertion of an arrow shaft. A plurality of threaded bearing holes are formed substantially equidistant through a perimeter of the outer housing. At least one threaded rod hole is preferably formed between adjacent threaded bearing holes. The mounting rod includes a threaded end, which is sized to be threadably engaged with one of the plurality of threaded rod holes. A plurality of graduations are formed along a length of the mounting rod.

Each bearing assembly includes a bearing housing, a tension adjustment screw, a bearing housing cap, a contact ball bearing, an inner ball bearing and a compression spring. The inner ball bearing and the tension spring are retained in one end of the bearing housing and the tension adjustment screw is threadably retained in the other end of the bearing housing. One end of an outer diameter of the bearing housing is sized to be threadably engaged with one of the at least two threaded bearing holes. The bearing housing cap includes an inner diameter for retaining the contact ball bearing. The inner diameter is threaded on to the other end of the bearing housing to retain the contact ball bearing in contact with the inner ball bearing. A second embodiment of the bearing assembly eliminates the inner ball bearing. A third embodiment of the bearing assembly eliminates the inner ball bearing and the compression spring.

The present invention allows for an arrow rest that solves all of the current problems associated with arrow rests on the market today. By using ball bearings within a housing, the arrow is supported by tangent points, not by surfaces. This style of full capture arrow rest has the least mechanically allowable contact surface area of any style arrow rest. Less contact surface means less drag, thus creating more speed.

Accordingly, it is an object of the present invention to provide a tangent point arrow rest, which fully captures an arrow for both bows and crossbows.

Finally, it is another object of the present invention to provide a tangent point arrow rest, which supports the arrow shaft with ball bearings to provide point contact and reduce friction.

These and additional objects, advantages, features and benefits of the present invention will become apparent from the following specification.

DETAILED DESCRIPTION OF THE PREFERRED EMBODIMENTS

Figure 1:
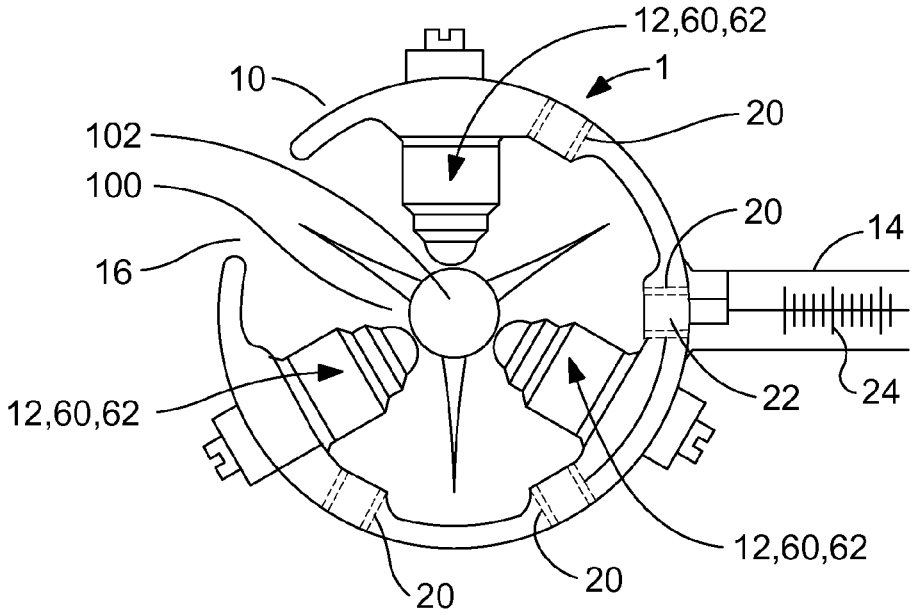
FIG. 1 is an end view of a tangent point arrow rest in accordance with the present invention.
Figure 2:
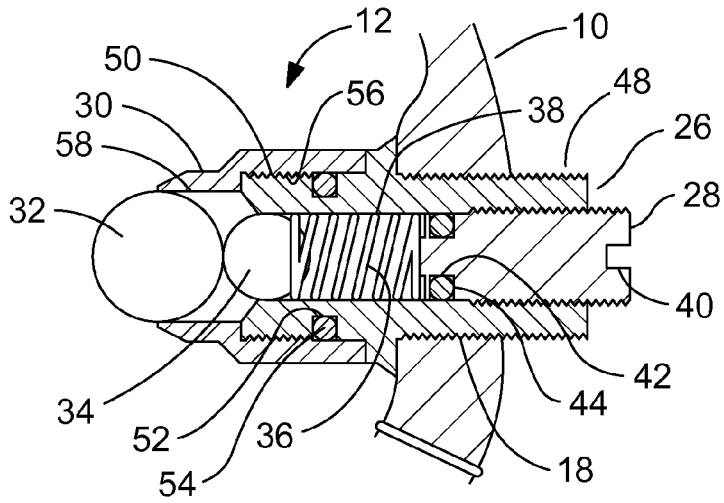
FIG. 2 is a cross sectional view of a bearing assembly of a tangent point arrow rest in accordance with the present invention.
Figure 5:
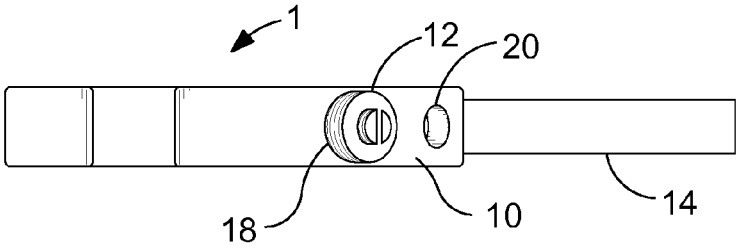
FIG. 5 is a top perspective view of a tangent point arrow rest in accordance with the present invention.
Figure 7:
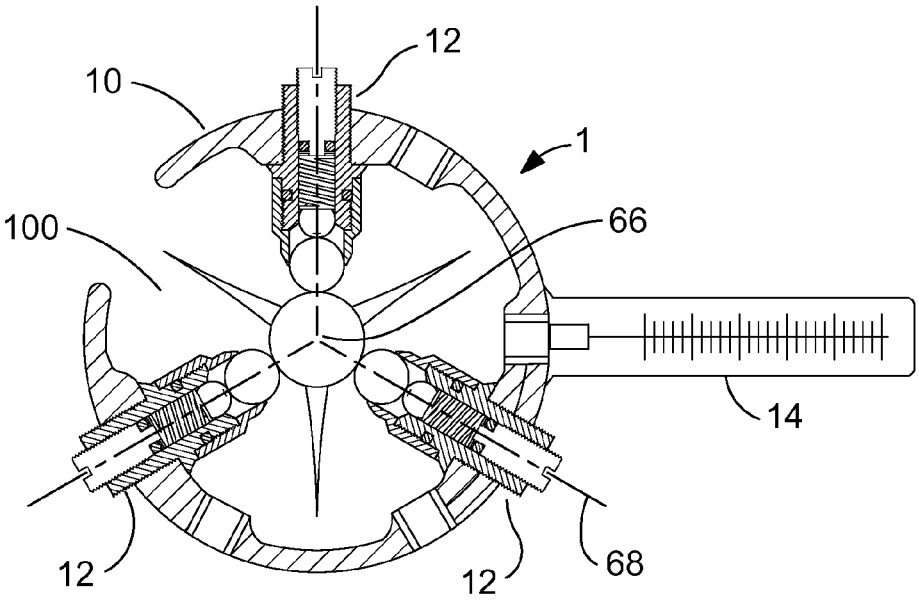
FIG. 7 is a cross sectional view of a tangent point arrow rest, after insertion of an arrow in accordance with the present invention.

With reference now to the drawings, and particularly to FIG. 1, there is shown an end view of a tangent point arrow rest 1. With reference to FIGS. 2 and 5, the tangent point arrow rest 1 preferably includes an outer housing 10, at least two bearing assemblies 12 and a mounting rod 14. With reference to FIG. 7, an arrow shaft 102 of an arrow 100 is retained by three bearing assemblies 12. The outer housing 10 preferably has a substantial ring shape with an arrow clearance opening 16 formed through the outer housing 10 for insertion of the arrow shaft 102.

Figure 8:
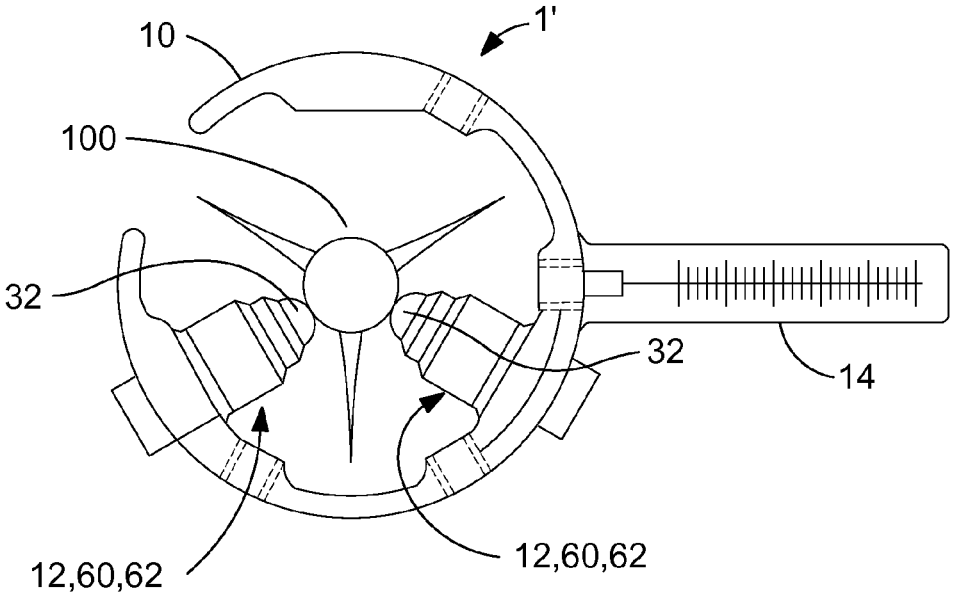
FIG. 8 is an end view of a tangent point arrow rest with two bearing assemblies and retaining an arrow in accordance with the present invention.

With reference to FIG. 8, the arrow shaft 102 is retained with two bearing assemblies 12, 60, 62 in a tangent point arrow rest 1'. Preferably, three threaded bearing holes 18 are formed substantially equidistant around a perimeter of the outer housing 10. At least one threaded rod hole 20 is preferably formed between adjacent threaded bearing holes 18. The mounting rod 14 includes a threaded end 22, which is sized to be threadably engaged with one of the plurality of threaded rod holes 20. A plurality of graduations 24 are preferably formed along a length of the mounting rod 14.

Each bearing assembly 12 preferably includes a bearing housing 26, a tension adjustment screw 28, a bearing housing cap 30, a contact ball bearing 32, an inner ball bearing 34 and a compression spring 36. The contact ball bearing 32 is preferably fabricated from ceramic, but could also be fabricated from stainless steel, nylon or any other suitable material. Preferably, a tapered bore 38 is formed in the bearing housing 26 to retain the inner ball bearing 34 and the compression spring 36 in one end of the bearing housing 26. The other end of the tapered bore 38 is threadably engaged with the tension adjustment screw 28. A slot 40 is preferably formed in one end of the tension adjustment screw 38 to receive a blade screw driver. An adjustment o-ring slot 42 is preferably formed around the other end of the tension adjustment screw 38 to receive an adjustment o-ring 44. The adjustment o-ring 44 prevents the tension adjustment screw 38 from loosening relative to the bearing housing 26.

The bearing housing 26 preferably includes a tightening ring 46, a housing thread 48, a cap thread 50 and an cap o-ring groove 52. The tightening ring 46 extends from an outer diameter of the bearing housing 26. The housing thread 48 is formed on one side of the tightening ring 46 and is sized to be threadably engaged with one of the plurality of threaded bearing holes 18. The cap thread 50 is formed on the other side of the tightening ring 46. The cap o-ring groove 52 is formed around a diameter of the bearing housing 26 between the tightening ring 46 and the cap thread 50. The cap o-ring groove 52 is sized to receive a cap o-ring 54.

Figure 3:
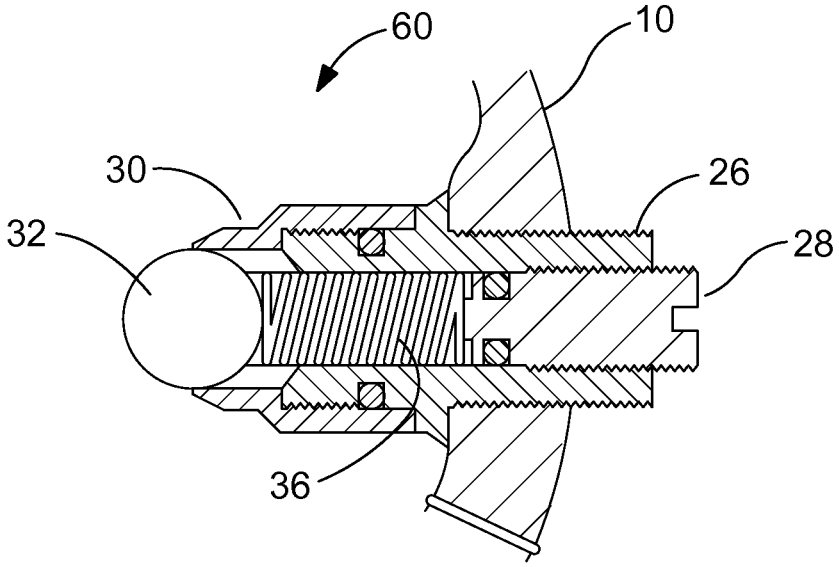
FIG. 3 is a cross sectional view of a second embodiment of a bearing assembly of a tangent point arrow rest in accordance with the present invention.
Figure 4:
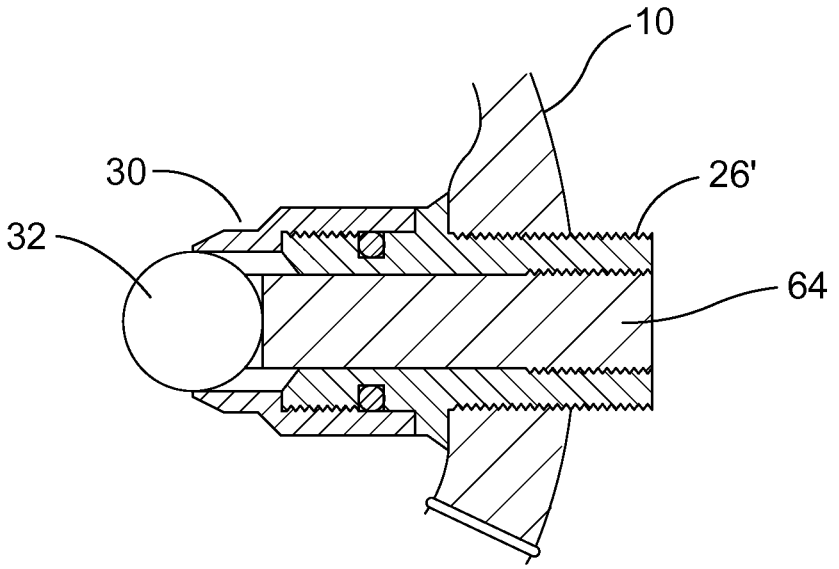
FIG. 4 is a cross sectional view of a third embodiment of a bearing assembly of a tangent point arrow rest in accordance with the present invention.

The bearing housing cap 30 includes a threaded cap bore 56 and a bearing bore 58. The thread cap bore 56 is sized to threadably engage the cap thread 50. The bearing bore 58 is sized to rotatably retain the contact ball bearing 32. Rotation of the tension adjustment screw 38 increases or decreases pressure on the contact ball bearing 32 through the inner ball bearing 34 and the compression spring 36. With reference to FIG. 3, a second embodiment of a bearing assembly 60 eliminates the inner ball bearing 34. With reference to FIG. 4, a third embodiment of a bearing assembly 62 eliminates the inner ball bearing 32 and the compression spring 34. The adjustment screw 28 is replaced with a bearing support plug 64 which is preferably threaded into the bearing housing 26'.

Figure 6:
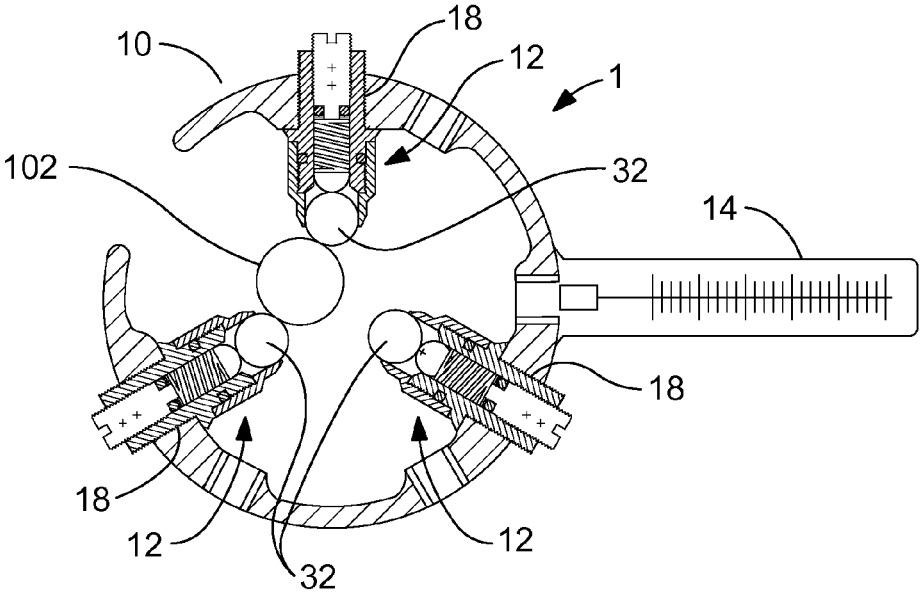
FIG. 6 is a cross sectional view of a tangent point arrow rest during insertion of an arrow in accordance with the present invention.
Figure 9:
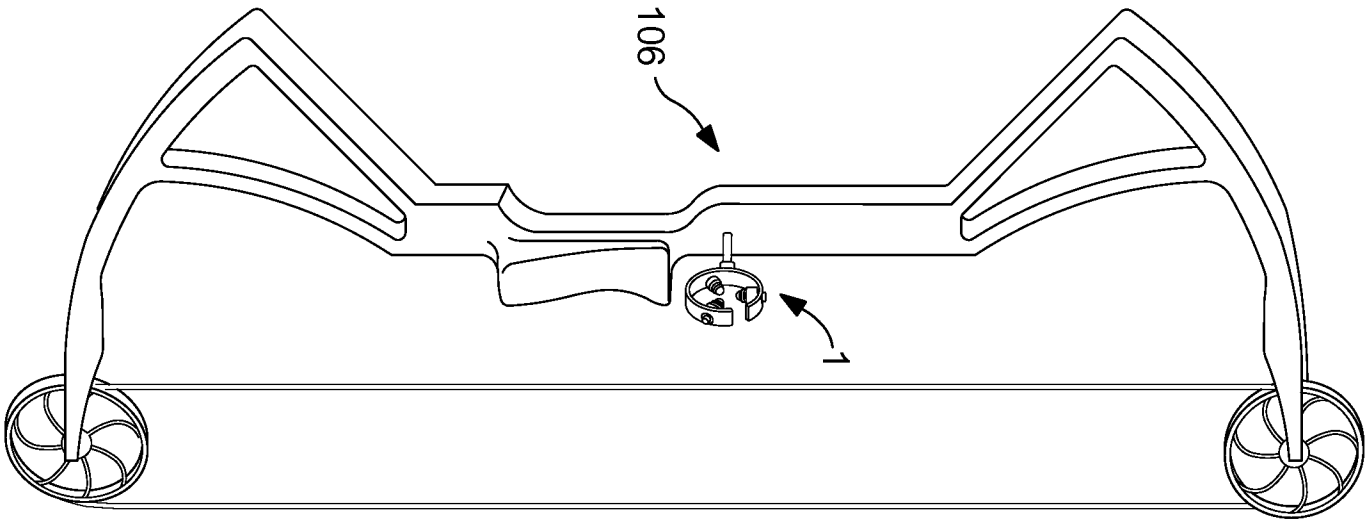
FIG. 9 is a perspective view of a tangent point arrow rest attached to a bow in accordance with the present invention.

FIG. 6 shows the arrow shaft 102 being inserted into the tangent point arrow rest 1. The center of the arrow shaft 102 becomes a theoretical center 66 of the three contact ball bearings 32. The three contact ball bearings 32 form a three tangent point rest for the arrow shaft 102. During the typical insertion of the arrow shaft 102, two of the contact ball bearings 32 are engaged by the arrow shaft 102, pushing the contact ball bearings 32 and the inner bearings 34 into the compression springs 36. The bearing assemblies 12 are preferably angular spaced around the housing 120 degrees away from each other and/or equidistant around a perimeter of the outer housing 10. FIG. 7 shows the tangent point arrow rest 1 with the arrow 100 retained by the three bearing assemblies 12. A center line 68 of each bearing assembly 12 extends radially from the theoretical center 66. FIG. 9 shows the tangent point arrow rest 1 attached to an archery bow 106.

Figure 10:
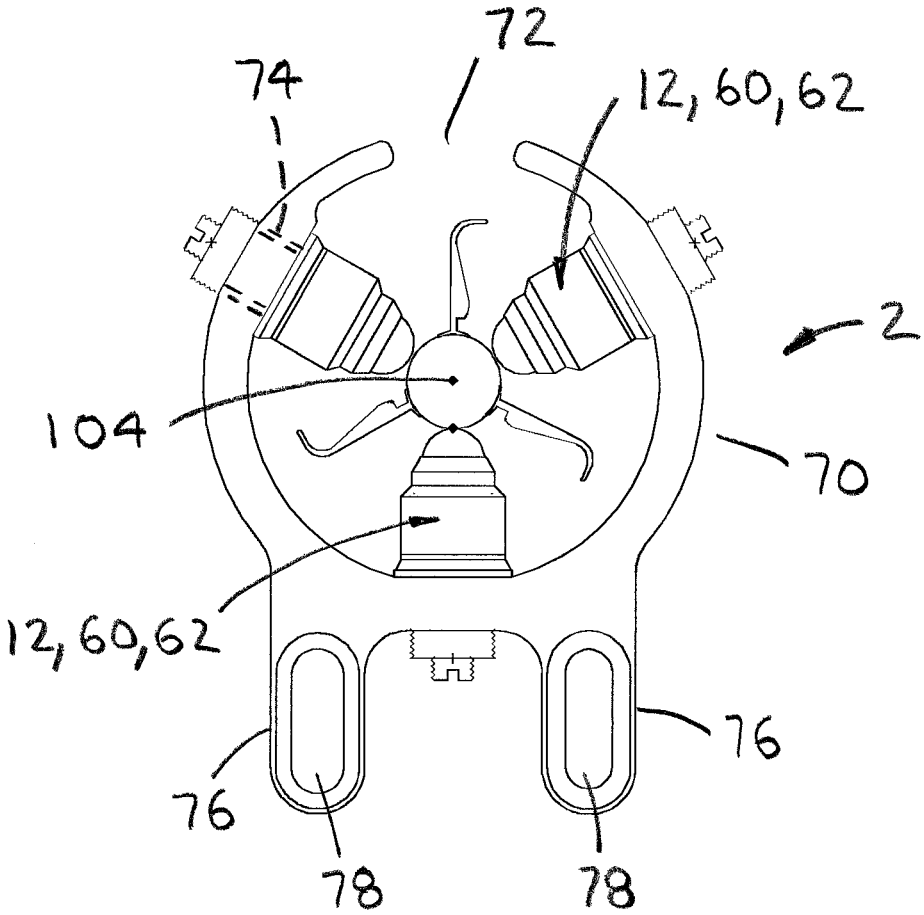
FIG. 10 is an end view of a second embodiment of a tangent point arrow rest in accordance with the present invention.

With reference to FIG. 10, a second embodiment of a tangent point arrow rest 2 preferably includes an outer housing 70 and the at least two bearing assemblies 12, 60, 62. The outer housing 70 preferably has a substantial ring shape with an arrow clearance opening 72 formed through the outer housing 70 for insertion of the arrow shaft 104. Preferably, three threaded bearing holes 18 are formed substantially equidistant around a perimeter of the outer housing 70 to threadably receive the at least two bearing assemblies 12, 60, 62. At least one boss slot 76 extends from a perimeter of the outer housing 70. Each boss slot 76 includes a fastener slot 78. A fastener (not shown) is inserted through the fastener slot 78 and attached to any suitable archery bow.

While particular embodiments of the invention have been shown and described, it will be obvious to those skilled in the art that changes and modifications may be made without departing from the invention in its broader aspects, and therefore, the aim in the appended claims is to cover all such changes and modifications as fall within the true spirit and scope of the invention.

We claim:

1. A tangent point arrow rest comprising:

an outer housing;

a mounting device extending from said outer housing; and at least two bearing assemblies each rotatably retaining a ball bearing, each one of said at least two bearing assemblies is retained in said outer housing, wherein an arrow shaft is supported by said at least two bearing assemblies; and an inner ball bearing is disposed below and in contact with said ball bearing, wherein an arrow shaft is supported by said at least two bearing assemblies.

2. The tangent point arrow rest of claim 1 wherein:

a clearance opening is formed through said outer housing for the insertion of the arrow shaft.

3. The tangent point arrow rest of claim 1 wherein:

said at least two bearing assemblies are one of angularly spaced at least 100 degrees from each other and substantially equidistant from each other.

4. The tangent point arrow rest of claim 1 wherein:

said inner ball bearing is biased with a spring.

5. The tangent point arrow rest of claim 4 wherein:

an adjustment screw adjusts tension on said ball bearing.

6. The tangent point arrow rest of claim 1 wherein:

an axial distance of at least one of said at least two bearing assemblies is changeable relative to said mounting device.

7. A tangent point arrow rest comprising:

an outer housing;

a mounting device extending from said outer housing; and at least two bearing assemblies end each rotatably retaining a ball bearing, each one of said at least two bearing assemblies is retained by said outer housing, said ball bearing is biased toward a center of said mounting device, wherein a lengthwise axis of at least one of said at least two bearing assemblies exerting force perpendicular to a lengthwise axis of an arrow shaft, the arrow shaft is supported by said at least two bearing assemblies; and an inner ball bearing is disposed below and in contact with said ball bearing, said inner bearing is smaller than said ball bearing, wherein an arrow shaft is supported by said at least two bearing assemblies.

8. The tangent point arrow rest of claim 7 wherein:

said ball bearings are fabricated from a ceramic material.

9. The tangent point arrow rest of claim 7 wherein:

a clearance opening is formed through said outer housing for the insertion of the arrow shaft.

10. The tangent point arrow rest of claim 7 wherein:

said at least two bearing assemblies are one of angularly spaced at least 100 degrees from each other and substantially equidistant from each other.

11. The tangent point arrow rest of claim 7 wherein:

said inner ball bearing is biased with a spring.

12. The tangent point arrow rest of claim 11 wherein:

an adjustment screw adjusts tension on said ball bearing.

13. The tangent point arrow rest of claim 7 wherein:

an axial distance of at least one of said at least two bearing assemblies is changeable relative to said mounting device.

14. A tangent point arrow rest comprising:

an outer housing;

at least one mounting device extending from said outer housing; and at least two bearing assemblies having a first end and a second end, said first end of each one of said at least two bearing assemblies is threadably engaged with said outer housing, wherein rotation of at least one of said at least two bearing assemblies changes an axial distance of said bearing assembly relative to said mounting device, a ball bearing rotatably retained in a second end of each one of said at least two bearing assemblies, said ball bearing is fabricated from a ceramic material, wherein an arrow shaft is supported by said at least two bearing assemblies; and an inner ball bearing is disposed below and in contact with said ball bearing, said inner ball bearing is smaller than said ball bearing, wherein an arrow shaft is supported by said at least two bearing assemblies.

15. The tangent point arrow rest of claim 14 wherein:

a clearance opening is formed through said outer housing for the insertion of the arrow shaft.

16. The tangent point arrow rest of claim 14 wherein:

said at least two bearing assemblies are one of angularly spaced at least 100 degrees from each other and substantially equidistant from each other.

17. The tangent point arrow rest of claim 14 wherein:

said inner ball bearing is biased with a spring.

* * * * *